US006479778B1

(12) United States Patent
Kimura et al.

(10) Patent No.: US 6,479,778 B1
(45) Date of Patent: Nov. 12, 2002

(54) VACUUM SWITCH INCLUDING WINDMILL-SHAPED ELECTRODES

(75) Inventors: Toshinori Kimura, Tokyo (JP); Kenichi Koyama, Tokyo (JP); Hiromi Koga, Tokyo (JP); Atsushi Sawada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/585,267

(22) Filed: Jun. 2, 2000

(30) Foreign Application Priority Data

Jun. 4, 1999 (JP) ..... 11-158757

(51) Int. Cl.[7] ..... H01H 33/66
(52) U.S. Cl. ..... 218/118; 218/123; 218/127
(58) Field of Search ..... 218/118, 120, 218/123–129, 146

(56) References Cited

U.S. PATENT DOCUMENTS

| | | | | |
|---|---|---|---|---|
| 3,522,399 A | * | 7/1970 | Crouch | 218/123 |
| 4,629,839 A | * | 12/1986 | Falkingham | 218/123 |
| 5,293,506 A | * | 3/1994 | Yorita | 218/118 |
| 5,763,848 A | * | 6/1998 | Hakamata et al. | 218/128 |
| 6,072,141 A | * | 6/2000 | Slamecka | 218/127 |
| 6,140,599 A | * | 10/2000 | Haas | 218/123 |

FOREIGN PATENT DOCUMENTS

| | | | |
|---|---|---|---|
| JP | 55-68020 | | 5/1980 |
| JP | 61-126720 | | 6/1986 |
| JP | 63-158722 | | 7/1988 |
| JP | 1-122528 | * | 5/1989 |

* cited by examiner

*Primary Examiner*—Lincoln Donovan
(74) *Attorney, Agent, or Firm*—Leydig, Voit & Mayer

(57) ABSTRACT

A vacuum switch includes a pair of windmill-shaped electrodes within a vacuum tube and including windmill portions and contact portions. Each of the windmill-shaped electrodes is arranged such that a component of a magnetic flux parallel to a contact surface and serving as an arc driving force with respect to a range of 0.5 mm from the contacting surface contacting the contacting portion of a leg portion of an arc has a magnetic flux density equal to or larger than 0.01 tesla with respect to an electric current of 1 kA, at any point on the contacting surface. The ratio of an inner diameter Di of the contact portion to an outer diameter D of the windmill-shaped electrodes is equal to or greater than 0.4, the difference in thickness between the windmill portions and the contact portions is equal to or less than 5 mm, and each of the windmill-shaped electrodes is connected to one of the pair of electrode rods, and a ratio of a diameter d of the connection portion of the electrode rod to an inner diameter Di of the contacting portion is equal to or less than 0.6. The windmill-shaped electrodes may be a Cu—Cr material including 20–60 weight % of Cr.

9 Claims, 9 Drawing Sheets

B: generated flux density
t : time for the arc initiating high speed rotation

B: generated flux density
Ip: current interrupting capability

Di: contacting portion Inner diameter
D: electrode outer diameter
Ip: current interrupting capability h: thickness difference between contacting portion and windmill portion (projecting height of contacting portion)
Ip: current interrupting capability d: joint hole diameter
Di: contacting portion inner diameter
Ip: current interrupting capability

VACUUM SWITCH INCLUDING WINDMILL-SHAPED ELECTRODES

BACKGROUND OF THE INVENTION

This invention relates to a vacuum switch including windmill-shaped electrodes therein.

FIG. 12 is a sectional view showing the overall structure of a vacuum switch which has a pair of contacts hermetically sealed within a highly evacuated vacuum vessel. An insulating cylinder 21 has attached to its opposite ends end plates 22*a* and 22*b* to constitute a vacuum vessel 23 of which an inner portion is highly evacuated. Opposingly disposed within the vacuum vessel 23 are a stationary electrode 1*a* secured to a tip of a stationary electrode rod 24*a* extending through one of the end plates 22*a* and a movable electrode 1*b* secured to a tip of a movable electrode rod 24*b* extending through the other of the end plates 22*b*.

A bellows 25 is disposed across the movable electrode rode 24*b* and the end plate 22*b*. The bellows 25 allows the movable electrode rod 24*b* connected to an operating device (not shown) to be driven to move the movable electrode rod 24*b* in the axial direction. This movement of the movable electrode rod 24*b* causes the electrode 1*a* of the stationary side and the electrode 1*b* on the movable side to be brought into and out of electrical contact. In order to prevent metal vapor diffused from the arc generated across the electrodes 1*a* and 1*b* from depositing on the inner wall surface of the vacuum vessel 23, a shield 26 is mounted to the inner wall surface of the insulating cylinder 21 by a shield support 27.

The electrodes 1*a* and 1*b* of such vacuum switch have the same configuration, which are windmill type with grooves in the electrode. By the provision of these grooves, the electrical path in the electrode is limited to define an electrical path of a reciprocating loop-shape extending in the circumferential direction, whereby the arc is driven by a magnetic field to move along the circumference of the electrode, so that the arc is prevented from staying at one position to avoid a local melting of the electrode, thus improving the interrupting performance. Also, in order to obtain a strong magnetic drive force immediately after the arc generation, the structure has the arc-running surface and contact surface in accordance with each other.

FIGS. 13 to 16 illustrate a structure of a windmill-shaped electrode of a conventional vacuum switch tube disclosed for example in Japanese Patent Laid-Open No. 4-368734, FIGS. 13 and 15 being plan views and FIGS. 14 and 16 being side views.

In the figures, the electrode rod 24 (the stationary electrode rod 24*a* or the movable electrode rod 24*b* ) have thereon a windmill-shaped electrode 1 (the stationary side electrode 1*a* or the movable side electrode 1*b*). The windmill-shaped electrode 1 is integrally comprised of an auxiliary electrode 31 and a ring-shaped electrode 32. The auxiliary electrode 31 comprises a central portion 33 mounted to an end portion of the electrode rod 24, a plurality of arms 34 disposed to the central portion 33 in a windmill-shape manner or Buddhist cross-shape and extending in an arc from the central portion 33 toward the outer circumferential portion, and connecting portion 35 disposed at each of the tips of the plurality of the arms 34. The ring-shaped electrode 32 has an annular shape with its width substantially equal to the width of the arms 34 of the auxiliary electrode 31 and the ring-shaped electrode 32 is connected to the connecting portions 35.

In such an arrangement, when the windmill-shaped electrodes 1 (the stationary side electrode 1*a* and the movable side electrode 1*b*) are separated, an electric arc generates at the contacting surface of the ring-shaped electrode 32. When the arc generates at the point A of FIGS. 15 and 16, for example, an electric current 11 flowing through the arms 34 of the auxiliary electrode 31 generates a magnetic drive force F in the circumferential direction of the ring-shaped electrode 32, whereby the arc is driven to rotate around the outer circumference of the ring-shaped electrode 32.

Also, when the arc generates at the position which is not the connecting portions 35, such as the point E of FIGS. 15 and 16, for example, a magnetic drive force in the circumferential direction of the ring-shaped electrode 32 is also generated by an electric current 12 flowing into the ring-shaped electrode 32 from the arms 34 of the auxiliary electrode 31. Therefore, the arc is rotated along the ring-shaped electrode 32.

As has been described, in the conventional windmill-shaped electrode 1, the arc generates at the ring-shaped electrode 32 and the arc is magnetically driven immediately after the arc generation. As a result of this, the local temperature rises at the windmill-shaped electrodes 1 due to the arc before it is magnetically driven after the arc generation, thus improving the interrupting performance.

In the windmill-shaped electrode 1 of the above-described conventional vacuum switch tube, when an electric arc is generated at a point E1 of FIG. 17, for example, between the neighboring connecting portions 35 and 35, in addition to the current I2 flowing into the arc through the arms 34*a*, an electric current I3 from the arm 34*b* flows. This current I3 generates a force F3 in the direction of preventing the rotation of the arc, so that the time from the arc generation until the magnetic driving of the arc cannot be made short, not improving the interrupting performance.

Accordingly, an object of the present invention is to provide a vacuum switch free from the above-discussed problems of the conventional vacuum switch.

Another object of the present invention is to provide a vacuum switch in which an electric arc can be strongly magnetically driven immediately after the arc generation irrespective of the position on the contacting surface between the stationary side electrode and the movable side electrode at which the arc is generated, thereby improving the interrupting performance.

SUMMARY OF THE INVENTION

With the above objects in view, the present invention resides in a vacuum switch comprising: a pair of windmill-shaped electrodes disposed within a vacuum tube and each having formed therein a plurality of spiral grooves extending from a central portion to a circumferential portion thereof, and including a windmill-shaped portion separated from each other by said grooves and a plurality of contact portions separated by said grooves and having a thickness larger than that of said windmill portion; said windmill-shaped electrodes being arranged such that said contact portions are brought into contact with each other when said pair of windmill-shaped electrodes are closed, an electric arc is generated on said contact portions when said pair of windmill-shaped electrodes are separated from each other, a magnetic flux is generated by an electric current flowing into the electric arc from said windmill portion, and that a component parallel to a contact surface of said magnetic flux and serving as an arc driving force with respect to a range of 0.5 mm from the contacting surface contacting with said contacting portion of the leg portion of said arc has a magnetic flux density equal to or larger than 0.01 tesla with respect to an electric current of 1 kA.

A ratio of an inner diameter Di of said contact portion to an outer diameter D of said windmill-shaped electrodes may be equal to or greater than 0.4.

The difference in thickness between the windmill portions and the contact portions may be equal to or less than 5 mm.

Each of said windmill-shaped electrodes may be connected to each of the pair of electrode rods, a ratio of a diameter d of said connection portion of said electrode rod to an inner diameter Di of said contacting portion may be equal to or less than 0.6.

The windmill-shaped electrodes may be made of a Cu—Cr material including 20—60 weight % of Cr.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
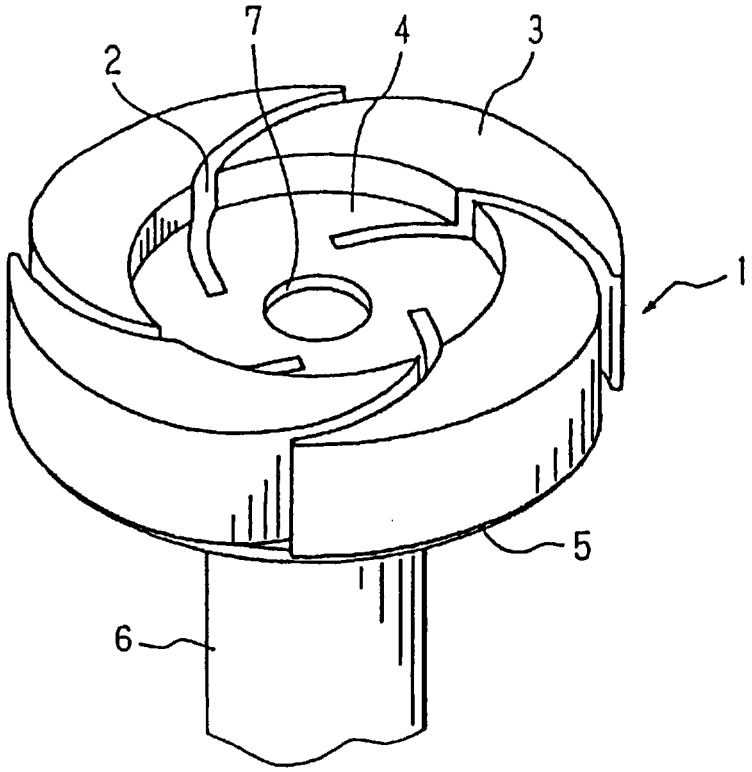
FIG. 1 is a perspective view showing a structure of a windmill-shaped electrode of a vacuum switch of the present invention.
Figure 2:
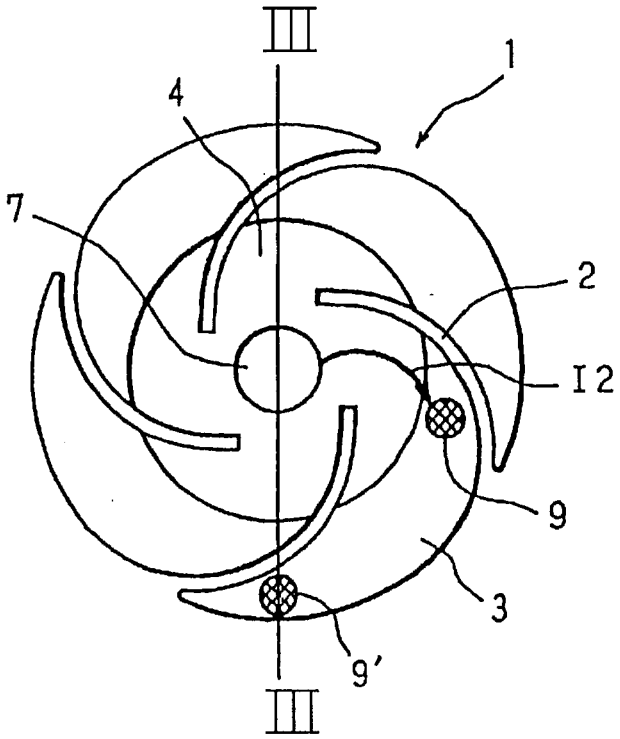
FIG. 2 is a plan view showing a structure of a windmill-shaped electrode of a vacuum switch of the present invention.
Figure 3:
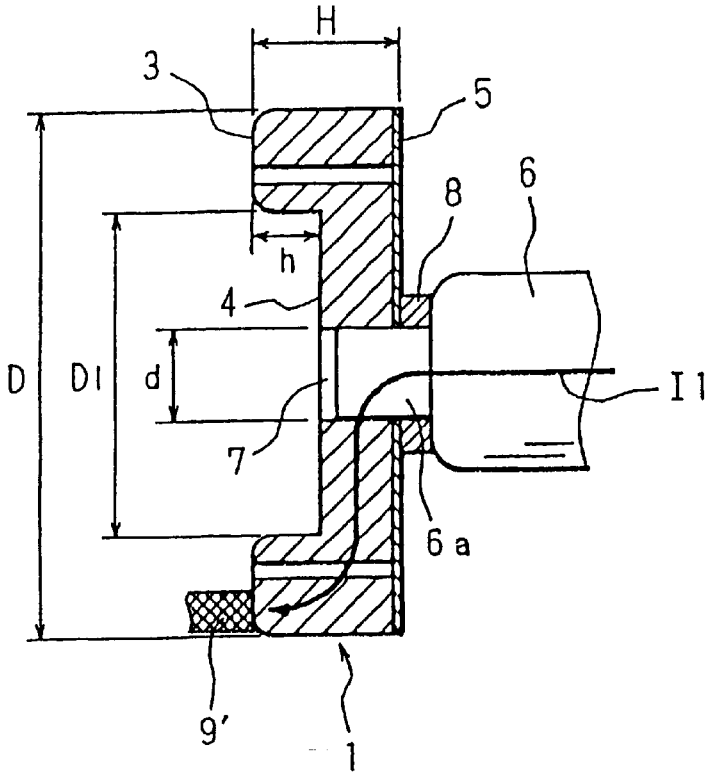
FIG. 3 is a sectional view taken along line III—III of FIG. 2.

FIG. 1 is a perspective view showing a structure of a windmill-shaped electrode of a vacuum switch of the present invention, FIG. 2 is a plan view thereof and FIG. 3 is a sectional view taken along line III—III of FIG. 2.

In the figures, reference numeral 6 is an electrode rod made of copper on the stationary side or on the movable side and the electrode rod 6 has secured thereto a windmill-shaped electrode (hereinafter simply referred to as electrode) 1. The electrode 1 is a flat disc-shaped member having a circular connecting hole 7 extending through its central portion, the electrode 1 being secured to the electrode rod 6 in such a manner that the tip portion 6*a* of a reduced diameter of the electrode rod 6 is inserted into the connecting hole 7. An electric current is introduced from the outside into the electrode 1 within the vacuum vessel (not shown) through the electrode rod 6.

The electrode 1 is made of a contact material of a Cu—Cr material including 20–60 weight % of Cr. The contact material of a Cu—Cr material including 20—60 weight % of Cr is superior in interrupting performance, and the improvement in the interrupting performance by using this material is intended.

The electrode 1 has formed therein four substantially spiral-shaped slots 2 extending from its central portion to the circumferential portion and from the front surface to the rear surface. The number of slots is not limited but may be any number so long as the flux density fulfills the required conditions. The electrode 1 comprises four contact portions 3 located at the circumferential peripheral portion and separated by the grooves 2 and having a large thickness, and a centrally positioned windmill portion 4 divided into four by the grooves 2 and having a small thickness. The arrangement is such that when the stationary side electrode rod 6 and the movable side electrode rod 6 come close to each other, their contacting portions 3 being brought into contact with each other.

On the rear surface of the electrode 1, a reinforcement plate 5 made of stainless steel for mechanically reinforcing the electrode is provided. Also, a spacer 8 made of stainless steel is inserted between the shoulder portion of the electrode rod 6 and the reinforcement plate 5, and the electrode rod 6, the reinforcement plate 5, and the spacer 8 are secured into an integral structure by brazing. The spacer 8 is provided for providing a strength to the connection portion of the electrode 1 and the electrode rod 6 and is made of stainless steel having an electric resistance larger than that of the electrode rod 6 made of copper in order to restrict the current flow to within the diameter of the connection portion (connecting hole 7).

In FIG. 3, the outer diameter of the electrode 1 is D, the inner diameter of the contacting portion 3 at the junction of the central portion and the contacting portion is Di, the height of the electrode 1 is H, the difference in thickness of the contacting portion 3, and the windmill portion 4, in the central portion of the electrode, (the projecting height of the contacting portion 3) is h, and the diameter of the connection hole 7 is d.

When the vacuum switch is closed, the contacting portion 3 of the stationary side electrode 1 and the contacting portion 3 of the movable side electrode 1 are in contact with each other and, when the current is to be interrupted, the contacting portions 3 of the electrodes 1 are separated from each other and generate an electric arc across the respective contacting portions 3. This arc can be generated at any position on the contacting portion 3, FIG. 2 illustrating an example where two arcs 9 and 9' are generated at two positions.

The electric current 11 flowing through the electrode 6 flows into the electrode 1 through the tip portion 6*a* to which the connecting hole 7 is fitted and flows into the arc 9 on the contacting portion 3 through the windmill portion 4 corresponding to the contacting portion on which the arc stays. This current flow is illustrated as a current 12 in FIG. 2. The arc 9 is subjected to a driving force in the radial direction due to the radial component of the current 12, and the arc 9 is subjected to a driving force in the circumferential direction due to the circumferential component of the current 12.

As a result, the arc 9, for example, is moved toward the position of the arc 9' and the arc 9' is moved to the next contact portion 3 in the clockwise rotation in FIG. 2. Therefore, the drive force acts upon the arc immediately after it is generated on the contacting portion 3 to initiate the rotation of the arc, continues such rotation of the arc while the arc is maintained.

Figure 4:
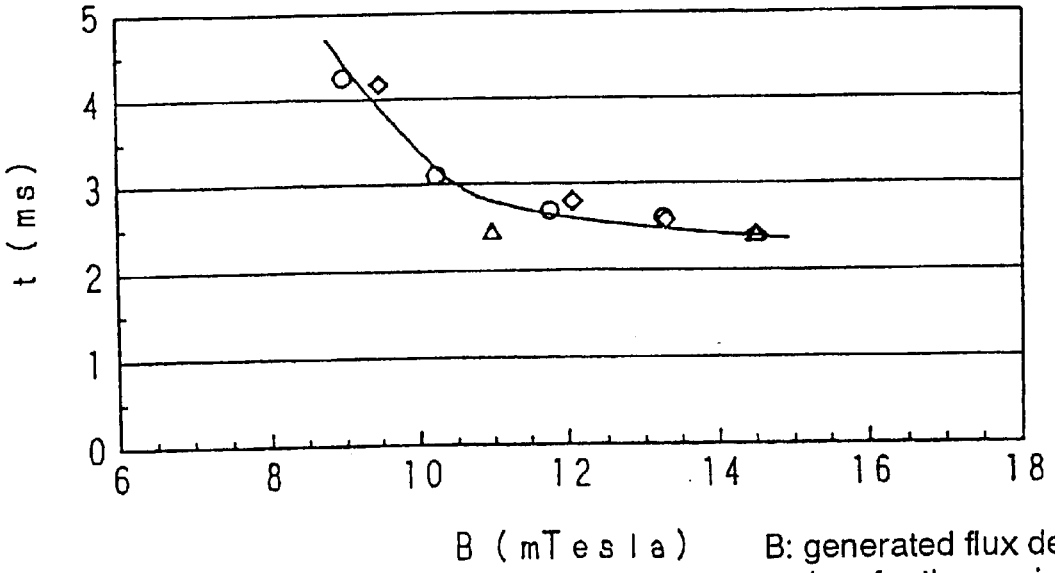
FIG. 4 is a graph showing the relationship between the magnetic flux density B generated and the time t at which the arc initiates a high speed rotation.
Figure 5:
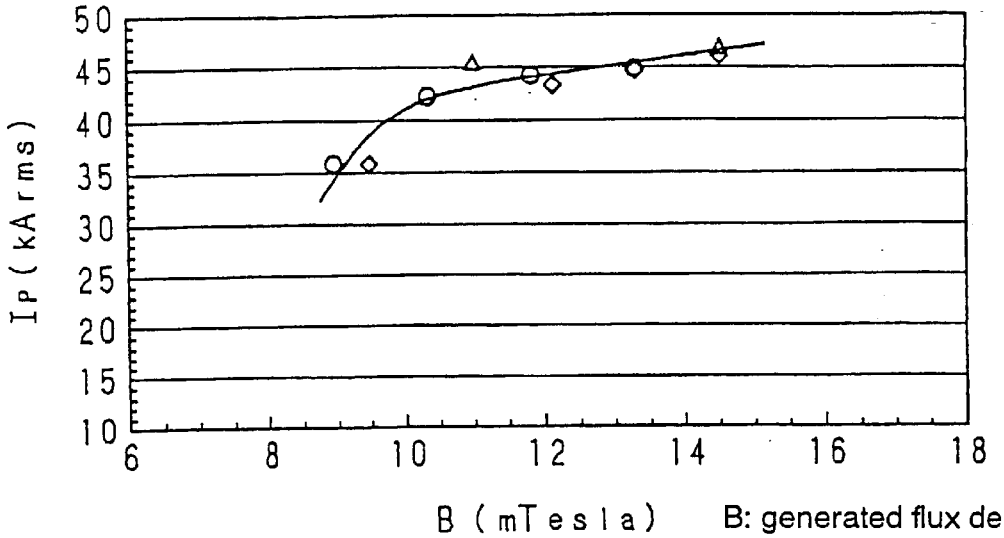
FIG. 5 is a graph showing the relationship between the magnetic flux density B generated and the current interrupting capability Ip.

A plurality of electrodes 1 which have various dimensions of D, Di, H, h, and d was manufactured in the time t it takes for the generated arc to initiate the high speed rotation and the current interrupting performance Ip have been measured and the flux density of the magnetic flux generated by the electrodes 1 was calculated. The calculation of the magnetic flux was conducted through the use of the three-dimensional current analysis software Eddy-™ (Photon Co. Ltd.). It is to be noted that the flux density was obtained as a component parallel to the contacting surface of the magnetic flux which serves as the arc driving force with respect to the range of 0.5 mm from the contacting surface of the electrode on which the arc leg portion stays out of the magnetic flux serving as a driving force with respect to the arc generated by a current flowing through the windmill portion of one of the electrodes. A conductivity of $5.0\times10^{7}\Omega^{-1}m^{-1}$ was used. As a result of the calculation, it was determined that the magnetic flux density varies according to the position on the contacting surface and that it is the lowest at the position closest to the electrode center (position 9 in FIG. 2) and the highest at the top portion (position 9' in FIG. 2). The drive characteristics of the arc were examined with a high speed camera. FIG. 4 shows the relationship between the time t and the magnetic flux density B per 1 kA of current, which is generated at the leg portion of the arc 9 by the current I1 and the current I2 and which serves as the arc driving force with respect to the range of 0.5 mm from the contact surface. It is to be noted that the flux density B is a value generated by the current flowing through the electrode with which the leg portion of the arc to be measured is brought into contact and is the value at the position on the contacting surface closest to the electrode center at which the magnetic flux density is lowest. Also, FIG. 5 illustrates the relationship between the magnetic flux density B and the current interrupting capability Ip.

As disclosed in the Japanese Institute of Electric Engineering, General Conference, 1998, 1501, with the windmill-shaped electrode, the electric arc begines to slowly move within 1 ms after the firing at the contacting portion (stagnation mode) and is rapidly accelerated (acceleration mode) and then is rotated at a high speed while emitting metal vapor (high speed mode). It is also known that the interrupting capacity is closely related with the time for entering into the high speed mode. From FIGS. 4 and 5, it is understood that by emplying the position at which the generated flux density per 1 kA current is equal to or more than 0.01 tesla (100 Gauss) as the contacting portion 3 where the arc is to be generated, the foregoing time t can be significantly shortened and the current interrupting performance Ip increases accordingly.

As has been described, according to the present invention, the arrangement is such that the arc is generated at the contacting portion 3 and the magnetic flux density of the flux that contributes to the driving of the leg portion (0.5 mm range from the contact surface) of the arc is equal to or more than 0.01 tesla per 1 kA current, the time it take for the arc from its generation to the initiation of the high speed rotation can be shortened and therefore a high interrupting capability can be obtained. Also, the grooves 2 are formed to extend to the outer circumference portion of the electrode 1, so that there is no incoming current from the neigboring contacing portion and the arc driving force is not decreased.

It is to be noted that the magnetic flux density serving as an arc driving force is larger at the position closer to the electrode surface and is smaller at the position farther from the surface. FIG. 18 illustrates how the flux density generated at the position closest to the electrode center by the current flowing through one of the opposing electrodes depends upon the vertical distance from the electrode surface. Therefore, the flux density acting on the arc when the stationary and the movable electrodes are actually brought into an opposed relationship is larger than the magnetic flux density by one of the electrodes and the flux density distribution profile at the gap between the electrodes is downwardy convexed with the smallest value located at the gap center. Further, since the gap-length between the stationary and the movable electrodes during the interruption varies with the lapse of time, the magnetic flux density generated at the leg portion of the arc by the current flowing through both electrodes also varies according to time. According to the present invention, the contribution of the electrode with which the arc leg is brought into contact is defined as o.o1 tesla or more per 1 kA current, thereby providing a clear definition of the necessary magnetic flux density. Therefore, no matter where the arc is generated on the contacting surface the function of strongly driving the arc immediately after the firing and shortening the arc stagnation time period can be achieved.

Figure 6:
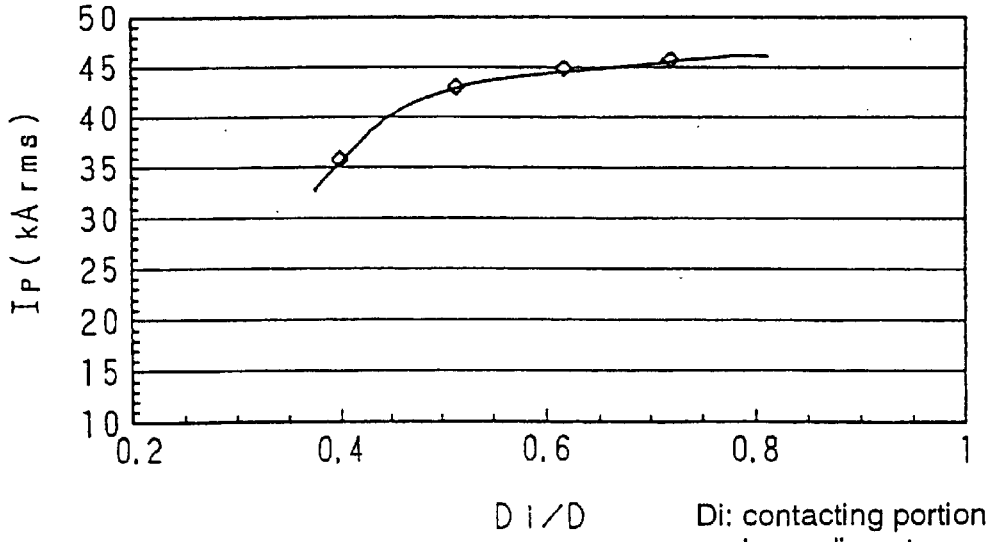
FIG. 6 is a graph showing the relationship between the Di/D (Di: inner diameter of the contacting portion, D: outer diameter of the electrode) and the current interrupting capability Ip.

The description will now be made as to the various dimensions of the electrode 1 for obtaining a good interrupting performance, such as D, Di, h and d. First, $Di \geqq 0.4D$. FIG. 6 is a graph showing the relationship between the Di/D and the current interrupting capability Ip obtained by the experiments with a plurality of electrodes 1 having various differing dimensions. It is seen from the graph that, by making Di/D equal to or larger than 0.4. i.e., $Di \geqq 0.4D$, the current interrupting capability is significantly improved. When this condition is satisfied, the flux density of the magnetic flux that contributes to the driving of the arc leg portion (the 0.5 mm range from the contact surface) is equal to or more than 0.01 tesla per 1 kA current.

Figure 7:
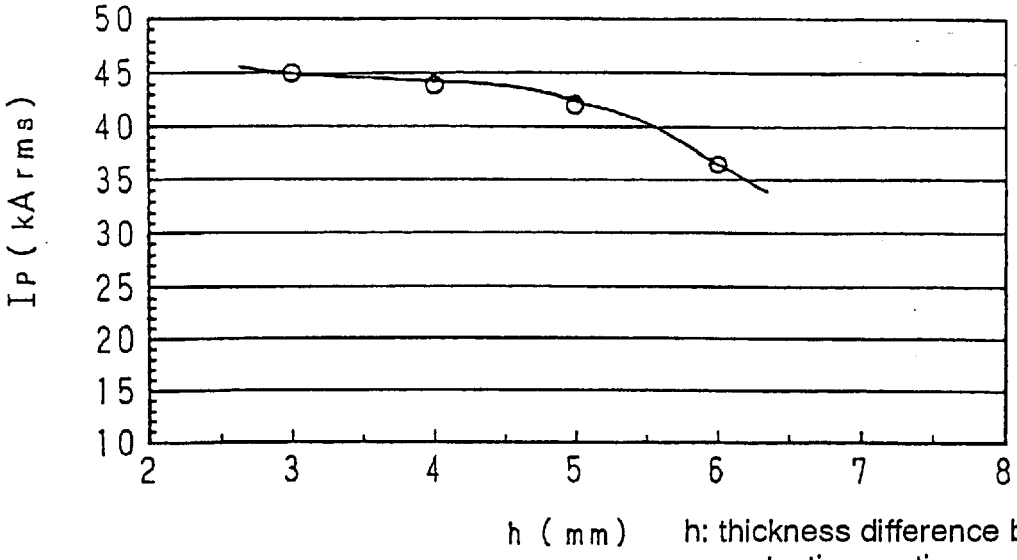
FIG. 7 is a graph showing the relationship between the difference h between the thickness of the contacting portion and the thickness of the windmill portion (projecting height of the contacting portion) and the current interrupting capability Ip.

Also, h is equal to or less than 5 mm. FIG. 7 is a graph showing the relationship between h and the current interrupting capability Ip as obtained from the test results by the previously described plurality of electrodes 1 having various differing dimensions. It is seen that by making h to be equal to or less than 5 mm, the current interrupting capability is significantly improved. Also when this condition is satisfied, the flux density of the magnetic flux that contributes to the driving of the arc leg portion (the 0.5 mm range from the contact surface) is equal to or more than 0.01 tesla per 1 kA current.

Figure 8:
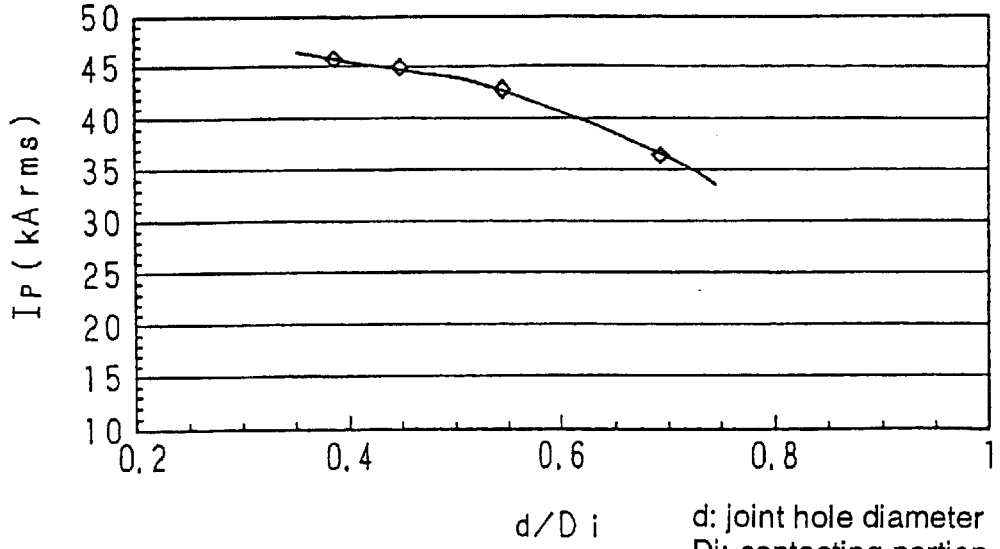
FIG. 8 is a graph showing the relationship between the d/Di (d: diameter of the connecting hole, Di: inner diameter of the contacting portion) and the current interrupting capability Ip.

FIG. 8 is a graph showing the relationship between the current interrupting capability Ip and the ratio d/Di obtained from experiments using electrodes 1 having various dimensions. FIG. 8 shows that making d/Di no more than 0.6 produces a significant improvement in current interrupting capability. When this condition is satisfied, the magnetic flux density that contributes to the driving of the arc leg portions (in the range of 0.5 mm from the contacting surface) is at least 0.01 tesla per 1 kA of current.

Figure 9:
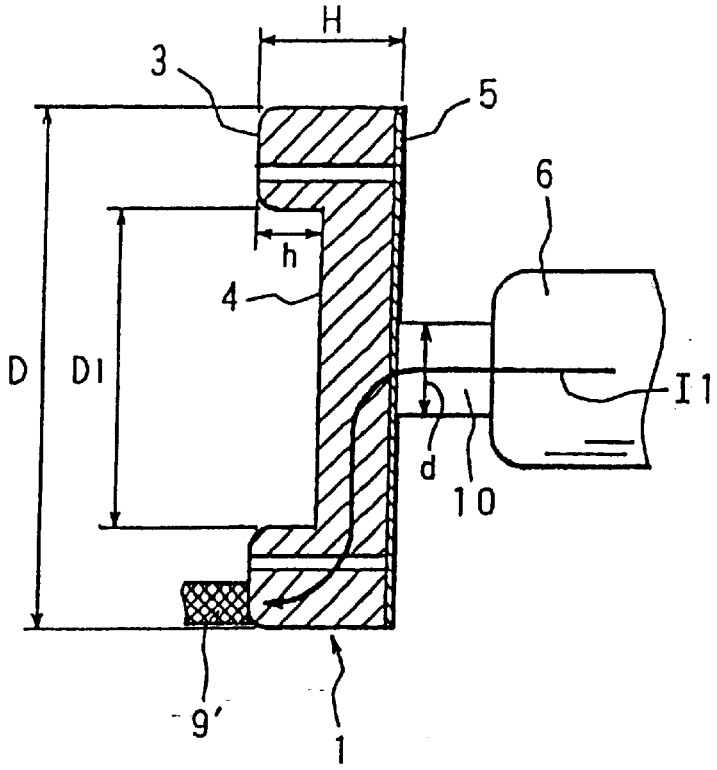
FIG. 9 is a sectional view showing a structure of a windmill-shaped electrode of a vacuum switch of another embodiment of the present invention.

FIG. 9 is a sectional view showing the structure of the windmill-shaped electrode of the vacuum switch of the second embodiment of the present invention. In FIG. 9, the components that have the same reference characters as those of FIG. 3 are identical or similar to each other. In the second embodiment, the electrode 1 has no joining hole provided therein and the tip portion of the electrode rod 6 at which the diameter is reduced is used as the joining portion 10 that is directly secured to the electrode 1 (or the reinforcement plate 5). The diameter d of the joining portion 10 satisfies a condition that a ratio of d to Di is equal to or less than 0.6.

Other configurations of the electrode 1, such as the shapes of the grooves 2, the contacting portions 3 and the windmill portions 4, are similar to those of the first embodiment, and the contacting portions 3 are projected so that a component parallel to the contact surface of the magnetic flux and serving as an arc driving force with respect to the range of 0.5 mm from the contacting surface contacting with the contacting portion of the leg portion of the arc has a magnetic flux density equal to or larger than 0.01 tesla with respect to an electric current of 1 kA.

In the second embodiment, there is no need to machine and form the joining hole 7 and the spacer 8 of the first embodiment. Also, the magnetic flux density generated in the second embodiment is at a level substantially equal to that of the first embodiment in which the joining hole 7 is provided, so that a sufficient interrupting performance similar to that of the first embodiment can be ensured. Thus, in the second embodiment, the manufacture of the electrode can be advantageously simplified and at the same time a high interrupting performance can be advantageously obtained.

Figure 10:
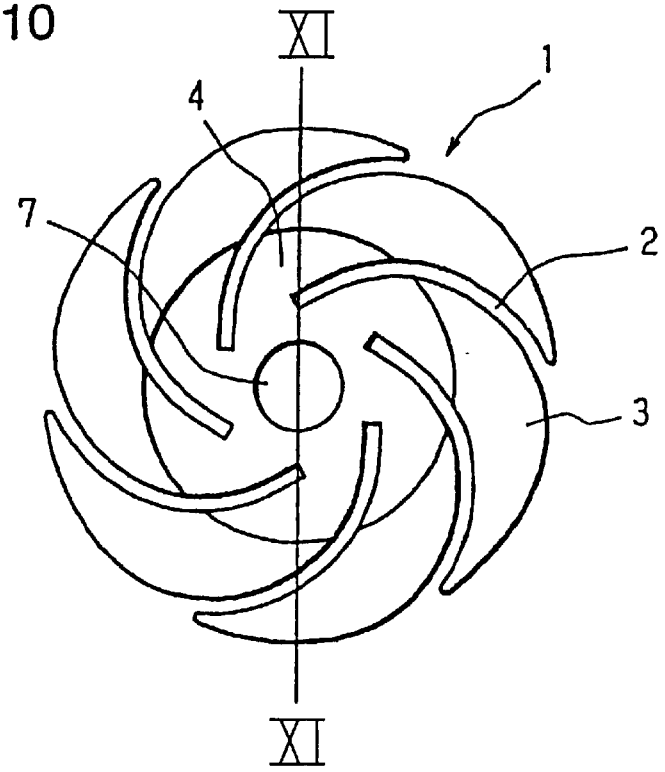
FIG. 10 is a plan view showing a structure of a windmill-shaped electrode of a vacuum switch of still another embodiment of the present invention.
Figure 11:
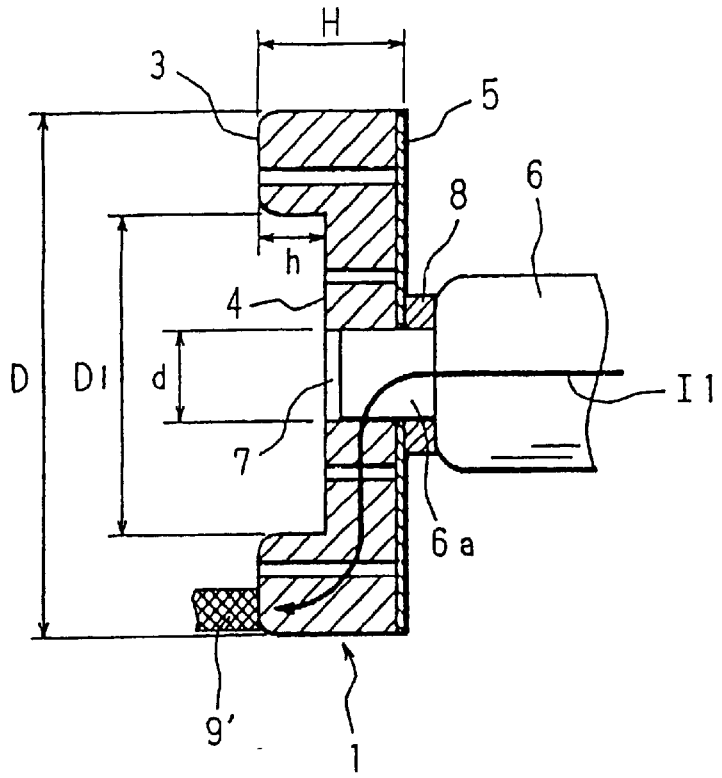
FIG. 11 is a sectional view taken along line XI—XI of FIG. 10.
Figure 12:
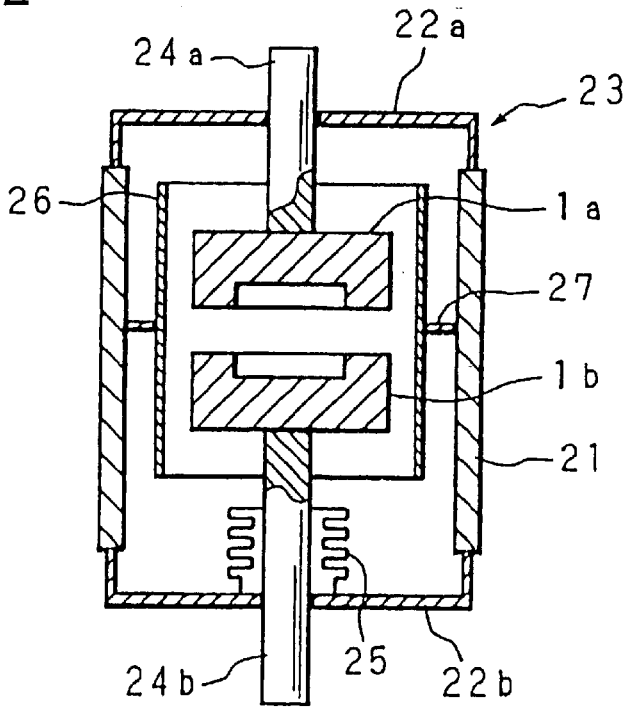
FIG. 12 is a view showing the overall construction of a vacuum switch.
Figure 13:
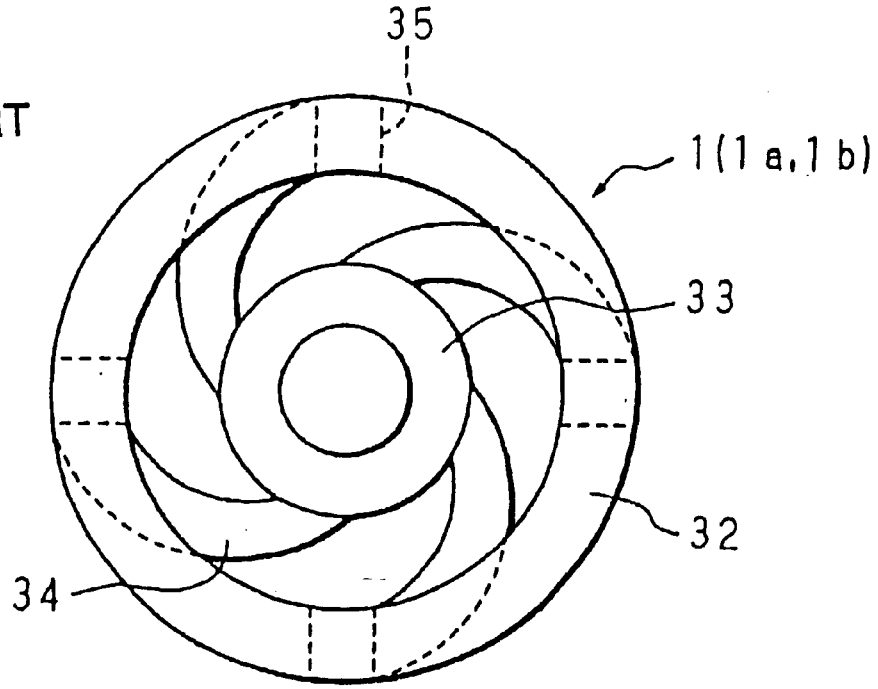
FIG. 13 PRIOR ART
FIG. 13 is a schematic plan view showing a structure of the windmill-shaped electrode of the conventional vacuum switch.
Figure 14:
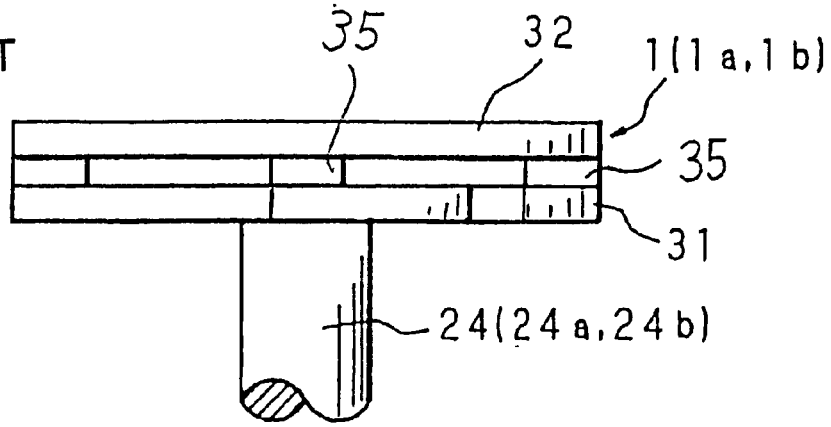
FIG. 14 PRIOR ART
FIG. 14 is a schematic side view showing a structure of the windmill-shaped electrode of the conventional vacuum switch.
Figure 15:
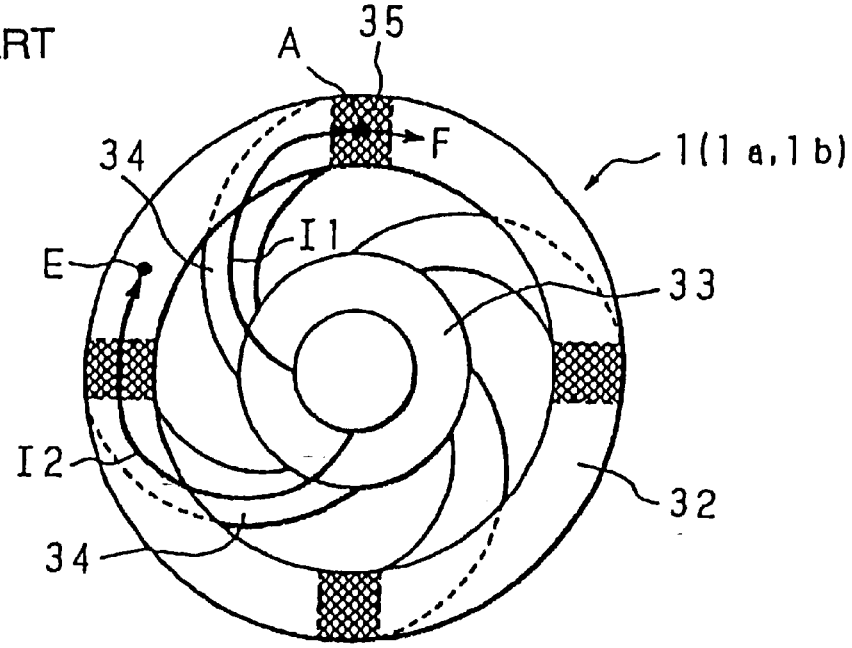
FIG. 15 PRIOR ART
FIG. 15 is a schematic plan view for explaining the operation of the windmill-shaped electrode of the conventional vacuum switch.
Figure 16:
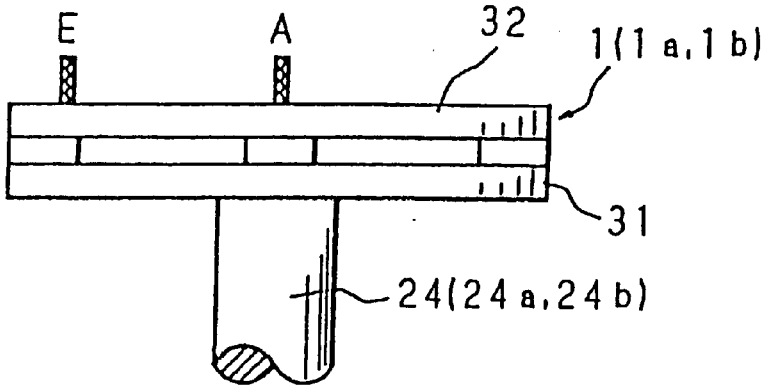
FIG. 16 PRIOR ART
FIG. 16 is a schematic side view for explaining the problems of the windmill-shaped electrode of the conventional vacuum switch.
Figure 17:
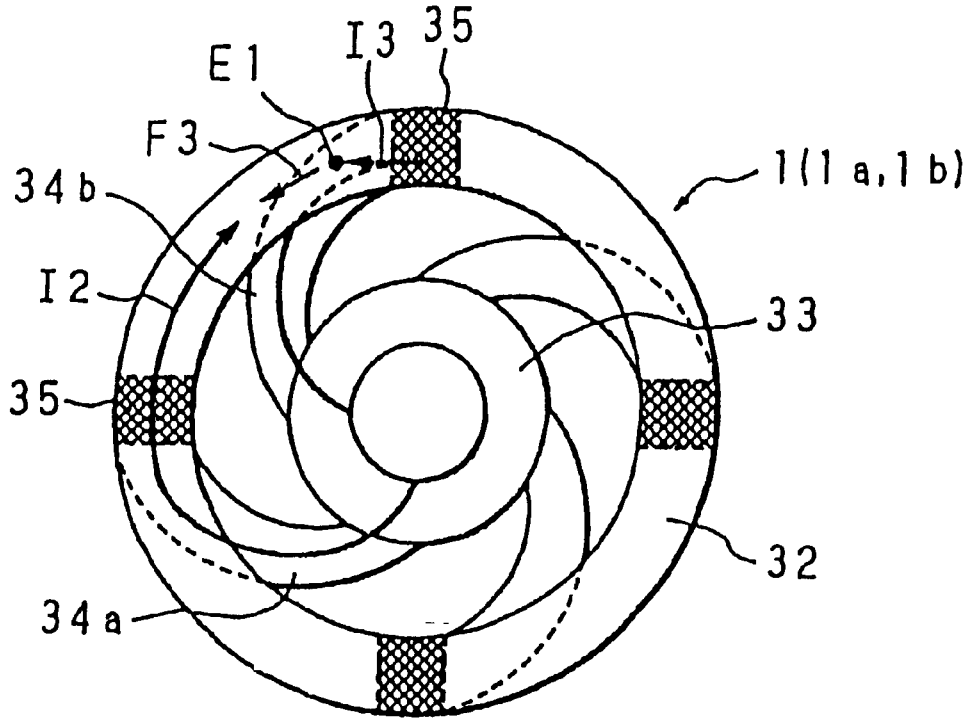
FIG. 17 PRIOR ART
FIG. 17 is a graph showing the dependency of the magnetic flux density upon the distance from the electrode surface.

FIG. 10 is a plan view showing the structure of the windmill-shaped electrode of the vacuum switch of the third embodiment of the present invention, and FIG. 11 is a sectional view taken along the line XI—XI of FIG. 10. In FIGS. 10 and 11, the components those have the same reference characters as those of FIG. 3 are identical or similar to each other. In this embodiment the number of the spiral grooves 2 is six.

It is to be noted that the contacting portions 3 and the windmill portions 4 of the electrode 1 has their basic configuration the same as those of the first embodiment except for the divided or sectioned numbers which are six. The contacting portions 3 are projected so that a component parallel to the contact surface of the magnetic flux and serving as an arc driving force with respect to the range of 0.5 mm from the contacting surface contacting with the contacting portion of the leg portion of the arc has a magnetic flux density equal to or larger than 0.01 tesla with respect to an electric current of 1 kA.

When the arrangement is such that an arc is generated at the contacting portions 3 and that the magnetic flux density contributing to the driving of the the leg portion of the that arc is equal to or larger than 0.01 tesla with respect to an electric current of 1 kA, the time between the arc generation and the initiation of the rotation can be shortened irrespective of the number of the spiral grooves 2, enabling to obtain a high interrupting capability.

As has been described, the vacuum switch of the present invention comprises a pair of windmill-shaped electrodes disposed within a vacuum tube and each having formed therein a plurality of spiral grooves extending from a central portion to a circumferential portion thereof, and including a windmill portion separated from each other by the grooves and a plurality of contact portions separated by the grooves and having a thickness larger than that of the windmill portion. The windmill-shaped electrodes is arranged such that the contact portions are brought into contact with each other when the pair of windmill-shaped electrodes are closed, an electric arc is generated on the contact portions when the pair of windmill-shaped electrodes are separated from each other, a magnetic flux is generated by an electric current flowing into the electric arc from the windmill portion, and that a component parallel to a contact surface of the magnetic flux and serving as an arc driving force with respect to a range of 0.5 mm from the contacting surface contacting with the contacting portion of the leg portion of the arc has a magnetic flux density equal to or larger than 0.01 tesla with respect to an electric current of 1 kA. Therefore, the time between the arc generation and the initiation of the rotation can be shortened irrespective of the number of the spiral grooves 2, enabling to obtain a high interrupting capability.

The ratio of an inner diameter Di of the contact portion to an outer diameter D of the windmill-shaped electrodes is equal to or greater than 0.4, so that the magnetic flux density contributing to the driving of the leg portion of the arc is equal to or larger than 0.01 tesla with respect to an electric current of 1 kA, a high interrupting capability can be obtained.

The difference in thickness between the windmill portions and the contact portions is equal to or less than 5 mm, so that the magnetic flux density contributing to the driving of the leg portion of the that arc is equal to or larger than 0.01 tesla with respect to an electric current of 1 kA, a high interrupting capability can be obtained.

The ratio of a diameter d of the connection portion of the electrode rod to an inner diameter Di of the contacting portion is equal to or less than 0.6, so that the magnetic flux density contributing to the driving of the leg portion of the that arc is equal to or larger than 0.01 tesla with respect to an electric current of 1 kA, a high interrupting capability can be obtained.

The windmill-shaped electrodes are made of a Cu—Cr material including 20–60 weight % of Cr, which exhibits a high interrupting performance, so that a high interrupting capability can be obtained.

What is claimed is:

1. A vacuum switch comprising:

a pair of windmill-shaped electrodes disposed within a vacuum tube, each windmill-shaped electrode having a circular central portion with a substantially uniform first thickness, a generally annular circumferential contact portion surrounding and contiguous to the central portion and having a second thickness larger than the first thickness, and a plurality of spiral grooves substantially perpendicular to and passing through the thickness of said central portion and said circumferential contact portion, extending from said central portion through said circumferential contact portion, defining windmill portions separated from each other by the grooves, and dividing said central portion into a plurality of windmill portions, wherein said circumferential contact portions have respective contact surfaces brought into contact with each other when said pair of windmill-shaped electrodes are in contact with each other, an electric arc is generated on said contact surfaces when said pair of windmill-shaped electrodes are separated from each other after being in contact with each other with an electrical current flowing through said pair of said windmill-shaped electrodes, and a magnetic flux is generated by an electric current flowing in the electric arc extending between respective circumferential contact portions of said windmill-shaped electrodes, said contact portions and said contact surfaces being shaped so that a component of the magnetic flux parallel to one of said contact surfaces at a distance of 0.5 mm from said contact surface has a magnetic flux density at least equal to 0.01 tesla per 1 kA of electric current flowing between said windmill-shaped electrodes.

2. The vacuum switch as claimed in claim 1, wherein said circumferential contact portion includes an inner diameter at a junction between said circumferential contact portion and said central portion and an outer diameter and a ratio of the inner diameter to the outer diameter is at least equal to 0.4.

3. The vacuum switch as claimed in claim 1, wherein the difference in thickness between said central portion and said circumferential contact portion is no more than 5 mm.

4. The vacuum switch as claimed in claim 1, including respective electrode rods connected to said windmill-shaped electrodes, each of said electrode rods having a connection portion with a diameter d, said circumferential contact portion has an inner diameter of Di at a junction between said central portion and said circumferential contact portion, and a ratio of the diameter d of the connection portion of said electrode rod to the inner diameter Di is no more than 0.6.

5. The vacuum switch as claimed in claim 1, wherein said windmill-shaped electrodes are a Cu—Cr material including 20–60 weight % of Cr.

6. A vacuum switch comprising:

a pair of windmill-shaped electrodes disposed within a vacuum tube, each windmill-shaped electrode having a circular central portion with a substantially uniform first thickness, a generally annular circumferential contact portion surrounding and contiguous to the central portion and having a second thickness larger than the first thickness, and a plurality of spiral grooves substantially perpendicular to and passing through the thickness of said central portion and said circumferential contact portion, extending from said central portion to said circumferential contact portion, defining windmill portions in said central portion separated from each other by the grooves, and dividing said circumferential contact portion into a plurality of contact portions, wherein said circumferential contact portion includes an inner diameter at a junction between said circumferential contact portion and said central portion, and an outer diameter, and a ratio of the inner diameter to the outer diameter is at least equal to 0.4.

7. The vacuum switch as claimed in claim 6, wherein the difference in thickness between said central portion and said circumferential contact portion is no more than 5 mm.

8. The vacuum switch as claimed in claim 6, including respective electrode rods connected to said windmill-shaped electrodes, each of said electrode rods having a connection portion with a diameter d, said circumferential contact portion having an inner diameter of Di at a junction between said central portion and said circumferential contact portion, and a ratio of the diameter d of the connection portion of said electrode rod to the inner diameter Di of said circumferential contact portion is no more than 0.6.

9. The vacuum switch as claimed in claim 6, wherein said windmill-shaped electrodes are a Cu—Cr material including 20–60 weight % of Cr.

* * * * *

UNITED STATES PATENT AND TRADEMARK OFFICE

CERTIFICATE OF CORRECTION

PATENT NO. : 6,479,778 B1
DATED : November 12, 2002
INVENTOR(S) : Kimura et al.

It is certified that error appears in the above-identified patent and that said Letters Patent is hereby corrected as shown below:

Column 5,
Line 11, change “11” to -- I1 --;
Lines 16, 18 and 20, change “12” to -- I2 --.

Signed and Sealed this

Eleventh Day of March, 2003

JAMES E. ROGAN
*Director of the United States Patent and Trademark Office*